US007992852B2

(12) United States Patent
Marineau et al.

(10) Patent No.: US 7,992,852 B2
(45) Date of Patent: Aug. 9, 2011

(54) PIPE STAND WITH ACCESSORIES

(75) Inventors: Melissa M. Marineau, Milwaukee, WI (US); Jonathan A. Zick, Waukesha, WI (US); Edward D. Wilbert, Hubertus, WI (US); Jeffrey M. Wackwitz, Menomonee Falls, WI (US); Benjamin Ludy, Waukesha, WI (US); Scott D. Eisenhardt, Pewaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 376 days.

(21) Appl. No.: 12/365,597

(22) Filed: Feb. 4, 2009

(65) Prior Publication Data

US 2009/0194923 A1 Aug. 6, 2009

Related U.S. Application Data

(60) Provisional application No. 61/026,031, filed on Feb. 4, 2008.

(51) Int. Cl.
*B25B 1/00* (2006.01)

(52) U.S. Cl. ..... 269/89; 269/16; 269/139; 269/136; 108/119

(58) Field of Classification Search ..... 269/89, 269/136–139, 16, 41; 108/119, 132, 35; 144/286.1, 296
See application file for complete search history.

(56) References Cited

U.S. PATENT DOCUMENTS 4,061,321 A * 12/1977 Farr ..... 269/41
4,527,786 A * 7/1985 Hsu ..... 269/154
5,329,979 A * 7/1994 Miller et al. ..... 144/329
5,806,947 A * 9/1998 Meisner et al. ..... 312/280
5,829,501 A * 11/1998 DeVito ..... 144/286.1
7,159,629 B1 * 1/2007 Rowe ..... 144/285
7,647,956 B1 * 1/2010 Cona et al. ..... 144/286.5
2009/0121405 A1 * 5/2009 Brown et al. ..... 269/216
2009/0194923 A1 * 8/2009 Marineau et al. ..... 269/89

OTHER PUBLICATIONS

Ridgid 1206 Power Drive Stand, drillspot.com, Available Online at: <http://www.drillspot.com/products/352536/Ridgid_1206_Power_Drive_Stand>, 2 pages, printed May 26, 2009, available by Jan. 9, 2008.

* cited by examiner

*Primary Examiner* — Lee D Wilson

(74) *Attorney, Agent, or Firm* — Michael Best & Friedrich LLP

(57) ABSTRACT

A pipe stand able to support a conduit includes a table having a first surface, supports pivotably coupled to the table for supporting the table in an elevated position with respect to the support surface, and a shelf extending between the supports and positioned between the table and the support surface. At least one of the supports includes an electrical connector, and a power cord is in electrical communication with the electrical connector and connectable to an external power source. The pipe stand includes a first jaw extending from the first surface of the table and shaped to engage a portion of the conduit, and a second jaw a second jaw extending from the first surface of the table and spaced a distance from the first jaw, the second jaw shaped to engage another portion of the conduit. A clamping device is supported by one of the first jaw and the second jaw. The clamping device includes a cord removeably coupled to the table and engageable with the conduit and a winch for biasing the cord with respect to the conduit.

20 Claims, 15 Drawing Sheets

PIPE STAND WITH ACCESSORIES

CROSS-REFERENCE TO RELATED APPLICATIONS

This application claims priority to U.S. Provisional Patent Application No. 61/026,031, entitled "Pipe Stand with Accessories," filed Feb. 4, 2008 by Melissa M. Marineau, Jonathan A. Zick, Edward D. Wilbert, Jeffrey M. Wackwitz, Benjamin Ludy, and Scott D. Eisenhardt, the entire contents of which is hereby incorporated by reference.

BACKGROUND OF THE INVENTION

The present invention relates to a pipe stand for supporting conduit, with the pipe stand including various accessories.

Construction and plumbing projects often require long, heavy conduit lengths. Given that conduit is normally ordered from wholesalers or stores, the conduit often arrives in standard lengths and requires modifications to properly fit. Modifications, such as cutting, and threading, require the conduit be stabilized and supported during the operation. Stabilizing a heavy piece of conduit can be awkward and unsafe, often times requiring the use of an additional worker. Pipe stands are able to safely secure the lengths of conduit at an elevation comfortable and easily accessible for the workers.

Often times, work sites are located in remote or outdoor settings creating issues with supplying proper power and/or other amenities. This can be particularly difficult when working on a pipe stand, which can require large clearances to facilitate the conduit being supported. Moreover, multiple devices may be required to complete a given task, resulting in issues with plug space and storage problems for tools not in use.

SUMMARY

In one embodiment, the invention provides a pipe stand able to support a conduit and including a table having a first surface, supports pivotably coupled to the table for supporting the table in an elevated position with respect to a support surface, and a shelf extending between the supports and positioned between the table and the support surface. At least one of the supports includes an electrical connector, and a power cord in electrical communication with the electrical connector and connectable to an external power source. The pipe stand includes a first jaw extending from the first surface of the table and shaped to engage a portion of the conduit, and a second jaw extending from the first surface of the table and spaced a distance from the first jaw, the second jaw shaped to engage another portion of the conduit. A clamping device is supported by one of the first jaw and the second jaw. The clamping device includes a cord removeably coupled to the table and engageable with the conduit and a winch for biasing the cord with respect to the conduit.

In another embodiment, the invention provides a pipe stand for supporting a conduit, the pipe stand including a table having a first surface, a plurality of supports pivotably coupled to the table for supporting the table in an elevated position with respect to a support surface, and a leveling system coupled to the table wherein the leveling system includes an adjustment apparatus for adjusting a length of at least one of the supports. At least one of the supports includes an electrical connector supported by at least one of the supports and a power cord in electrical communication with the electrical connector and connectable to an external power source. The pipe stand further includes a shelf extending between the supports and positioned between the table and the support surface, a first jaw extending from the first surface of the table and shaped to engage a portion of the conduit, and a second jaw extending from the first surface of the table and spaced a distance from the first vise jaw, the second jaw shaped to engage another portion of the conduit. Where at least one of the first jaw and the second jaw includes a clamping device, the clamping device including a cord removeably coupled to the table and engageable with the conduit and a winch for biasing the cord with respect to the conduit.

In yet another embodiment, the invention provides a pipe stand for supporting a conduit, the pipe stand including a table having a first surface, a plurality of supports pivotably coupled to the table for supporting the table in an elevated position with respect to a support surface and wherein at least one of the supports includes an electrical connector, and a power cord in electrical communication with the electrical connector and connectable to an external power source. The pipe stand further includes a shelf extending between the plurality of supports and positioned between the table and the support surface, a first jaw extending from the first surface of the table and shaped to engage a portion of the conduit, and a second jaw extending from the first surface of the table and spaced a distance from the first jaw, the second jaw shaped to engage another portion of the conduit. At least one of the first jaw and the second jaw including a vise clamping device.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
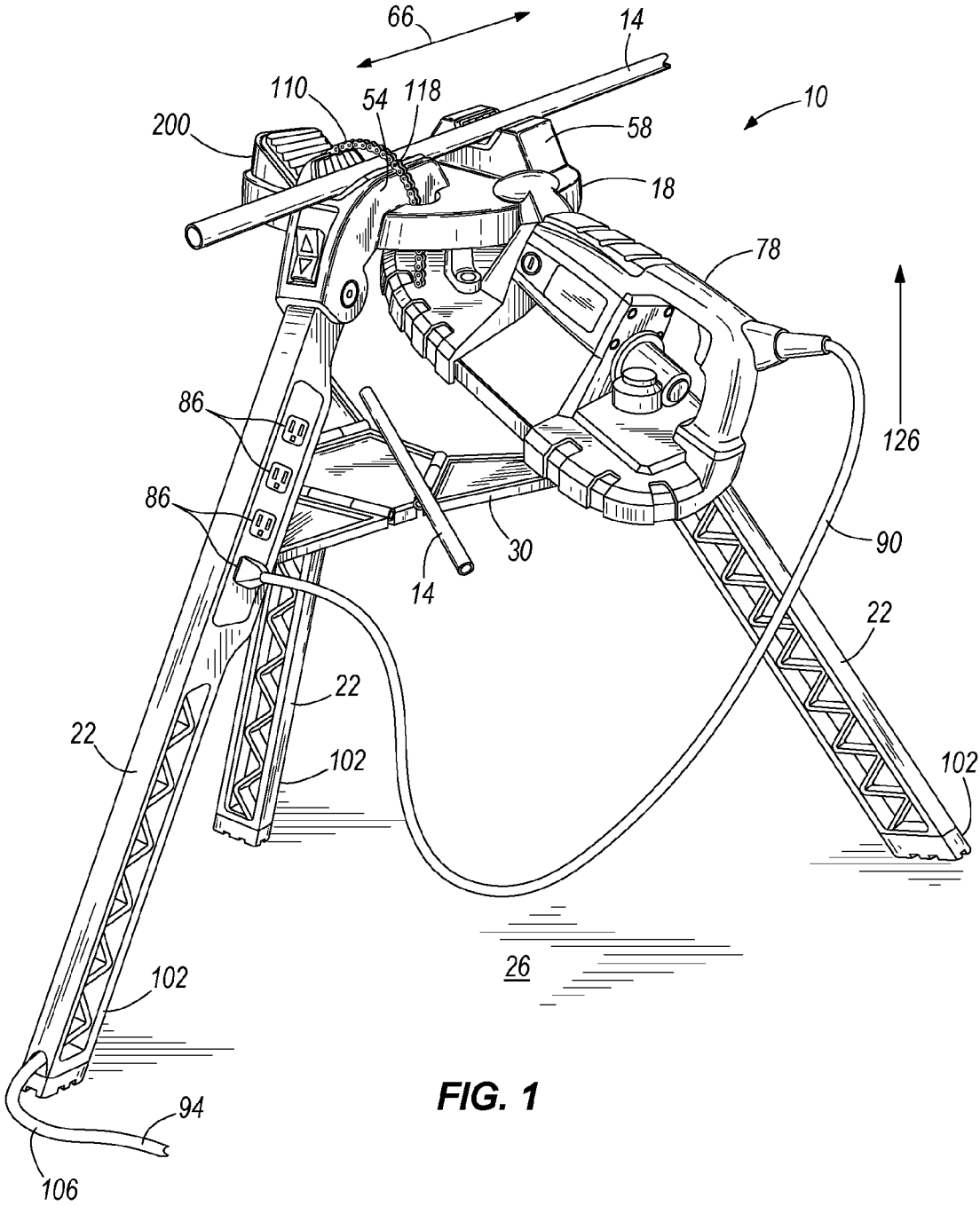
FIG. 1 is a perspective view of a pipe stand according to an embodiment of the invention.
Figure 2:
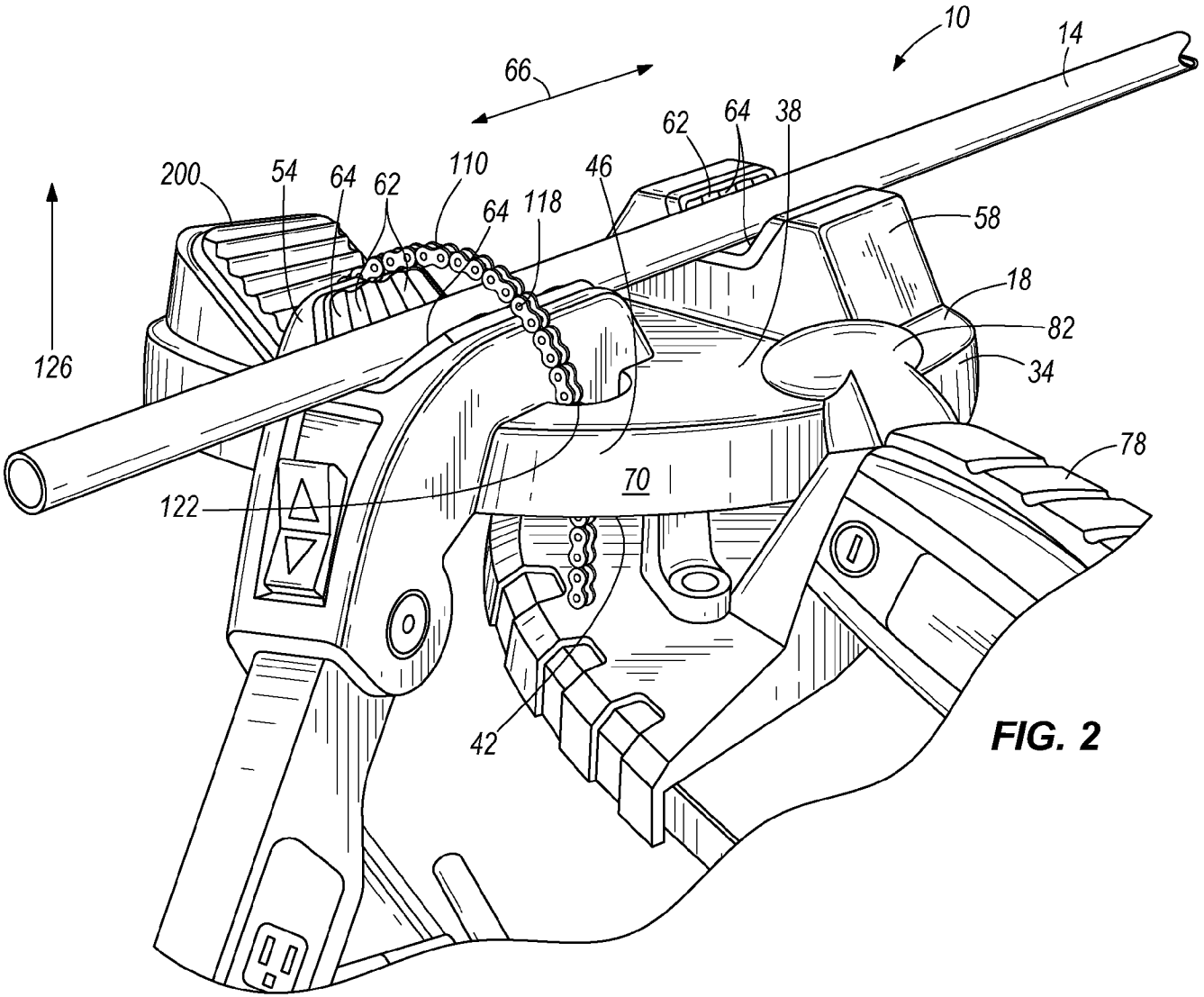
FIG. 2 is an enlarged view of a table of the pipe stand shown in FIG. 1.

FIGS. 1 and 2 illustrate a pipe stand 10 according to one embodiment of the invention. The illustrated pipe stand 10 may support various accessories (e.g., power tools, clamping devices, lights, power sources, etc.) and a pipe 14. The illustrated pipe 14 has a substantially circular cross-section; however, in other embodiments, the pipe 14 may have a rectangular-shaped cross-section or other various cross-sections.

In the illustrated embodiment, the pipe stand 10 includes a table 18, three supports 22 for supporting the table 18 in an elevated position with respect to a support surface 26 (such as a floor), and a shelf 30 extending between the supports 22 and positioned between the table 18 and the support surface 26. Referring to FIG. 2, the table 18 includes a first table edge 34 defining a first surface 38, a second table edge 42, a lip 46 extending between the first and second table edges 34, 42, and a second surface (not shown) opposite the first surface 38 and recessed from the second table edge 42 toward the first surface 38.

As shown in FIG. 2, the first surface 38 of the table 18 includes a first jaw 54, and a second jaw 58 spaced a distance from the first jaw 54. The first and second jaws 54, 58 are substantially "V" shaped and define a pair of angled surfaces 56 configured to support the pipe 14 in a substantially horizontal orientation. The angled surfaces 56 also limit lateral movement of the conduit with respect to the table 18. The angled surfaces 56 include a plurality of pipe engaging ribs 62 to restrict rotation of the pipe 14 with respect to the table 18.

The lip 46 of the table 18 includes an exterior surface 70 adjacent the first surface 38 and an interior surface (not shown) adjacent the second surface. The lip 46 of the table 18 allows for attachment of a portable power tool, such as a band saw 78 or other pipe cutting device. The band saw 78 includes a handle 82 for releasably engaging to the first surface 38 of the table 18 and thereby coupling the band saw 78 to the pipe stand 10. In other embodiments, the handle 82 is a first handle and engages the first surface 38 and a second handle extends from the band saw 78 and engages the second surface or the lip 46.

As illustrated in FIG. 1, one of the supports 22 includes four GFCI outlets 86; however, in other embodiments, any number or type of outlets 86 may be included on the support 22. Each outlet 86 provides electrical power to an electrical component or accessory, such as the band saw 78, via an accessory power cord 90 of the component. The electrical power is supplied from a remote power source (e.g., wall outlet, power generator, battery) to the outlets 86 by way of a pipe stand power cord 94. A first portion (not shown) of the pipe stand power cord 94 is positioned within the support 22 and extends from the outlets 86 to a base 102 of the support 22 that abuts the support surface 26. Proximate the base 102, a second portion 106 of the pipe stand power cord 94 protrudes from the support 22 and is connectable to the remote power source (not shown). Each outlet 86 is a local power source such that, for example, the portable power tools (e.g., the band saw 78) may be powered directly by the pipe stand 10 (i.e., by the outlets 86 located on the support 22). The local power source allows the portable power tools to be operated without the use of known equipment or accessories, such as extension cords, rechargeable battery packs, etc.

In other embodiments, more than one support 22 of the pipe stand 10 includes the outlets 86. In one embodiment, a single pipe stand power cord 94 is wired within the pipe stand 10 to the outlets 86 of each support 22. In another embodiment, three pipe stand power cords 94 (one for each support 22) are used to supply electrical power to the outlets 86 of each support 22.

In the illustrated embodiment shown in FIG. 1, each support 22 is pivotally coupled to the table 18. The pivotal coupling allows each support 22 to fold inwardly, creating compact portability and storage capabilities for the pipe stand 10. In addition, the table 18 as well as the shelf 30 may be collapsible, therein providing an even more-compact pipe stand 10.

In other embodiments, each support 22 includes a wheel (not shown) coupled to its base 102. The wheels create a mobile pipe stand 10 and allow a user to transport the pipe stand 10 to various locations. In addition, each wheel may include a brake such that the user may lock the pipe stand 10 in a specific position and prevent any movement of the pipe stand 10 with respect to the support surface 26.

The shelf 30 of the pipe stand 10 (FIG. 1) supports and stores various items that may be used by the user. For example, the shelf 30 may support a pipe 14, paper documents, a radio, portable power tools, extension cords, etc.

FIGS. 1 and 2 illustrate a clamping device 110 for resisting movement of the pipe 14 with respect to the pipe stand 10. The clamping device 110 may be removably coupled to the table 18 of the pipe stand 10. The clamping device 110, illustrated in FIGS. 1 and 2, includes a clamping mechanism, for example, a winch (not shown) and a chain 118 for engaging a portion of the circumference of the pipe 14. The clamping device 110 removably couples the pipe 14 to the table 18 (e.g., to the jaws 54, 58 of the table 18). The clamping mechanism is positioned beneath the table 18, proximate the second surface, to prevent interference of the clamping device 110 with any pipe operations (i.e., pipe cutting). The chain 118 may extend from the clamping mechanism, over the pipe 14, and through an aperture 122 of the table 18. Tightening of the chain 118 with the clamping mechanism secures the pipe 14 to the pipe stand 10 and resists movement of the pipe 14 in a vertical direction 126, as shown in FIG. 1.

Figure 3A:
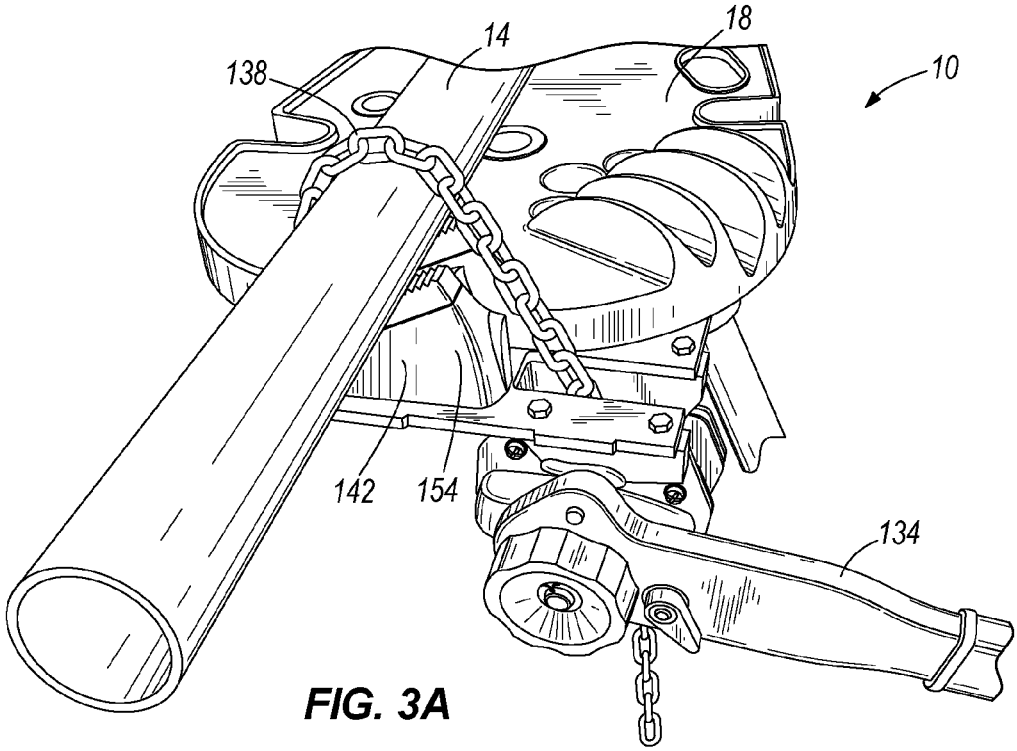
FIGS. 3A-3C are perspective views of a clamping device for the pipe stand shown in FIG. 1.
Figure 3B:
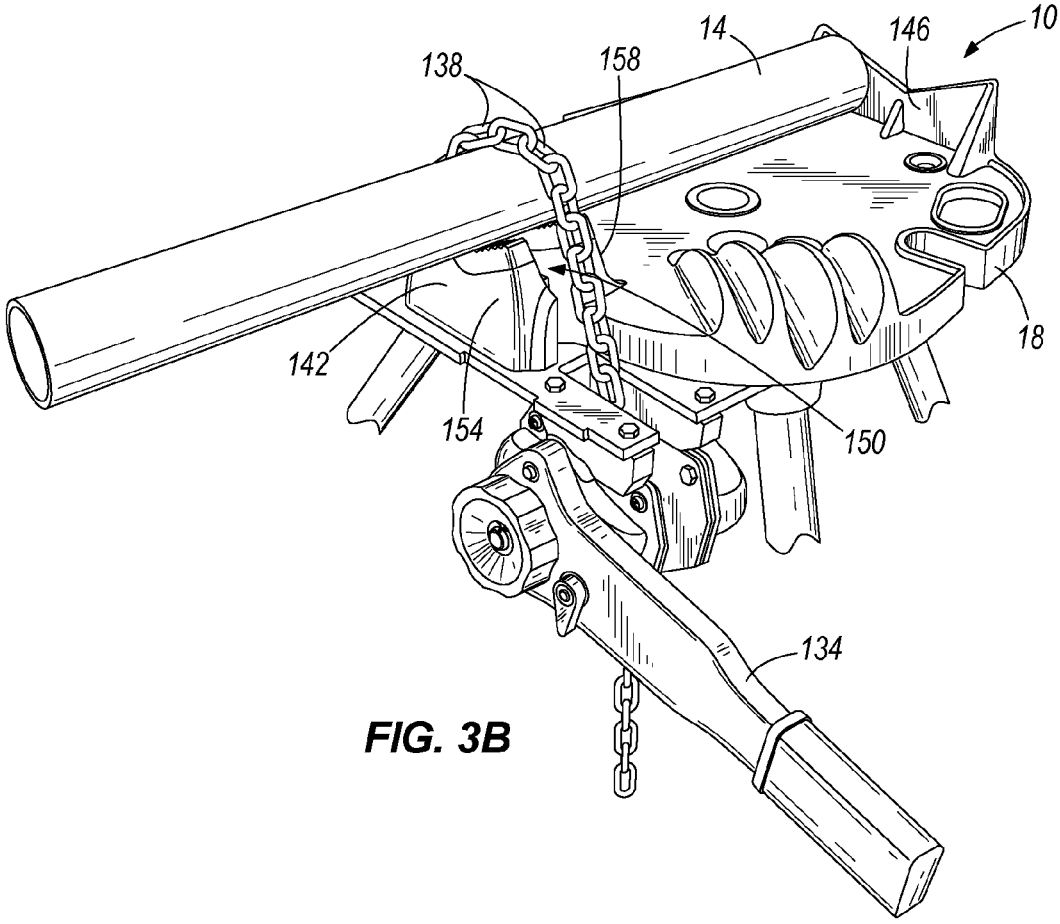
Figure 3C:
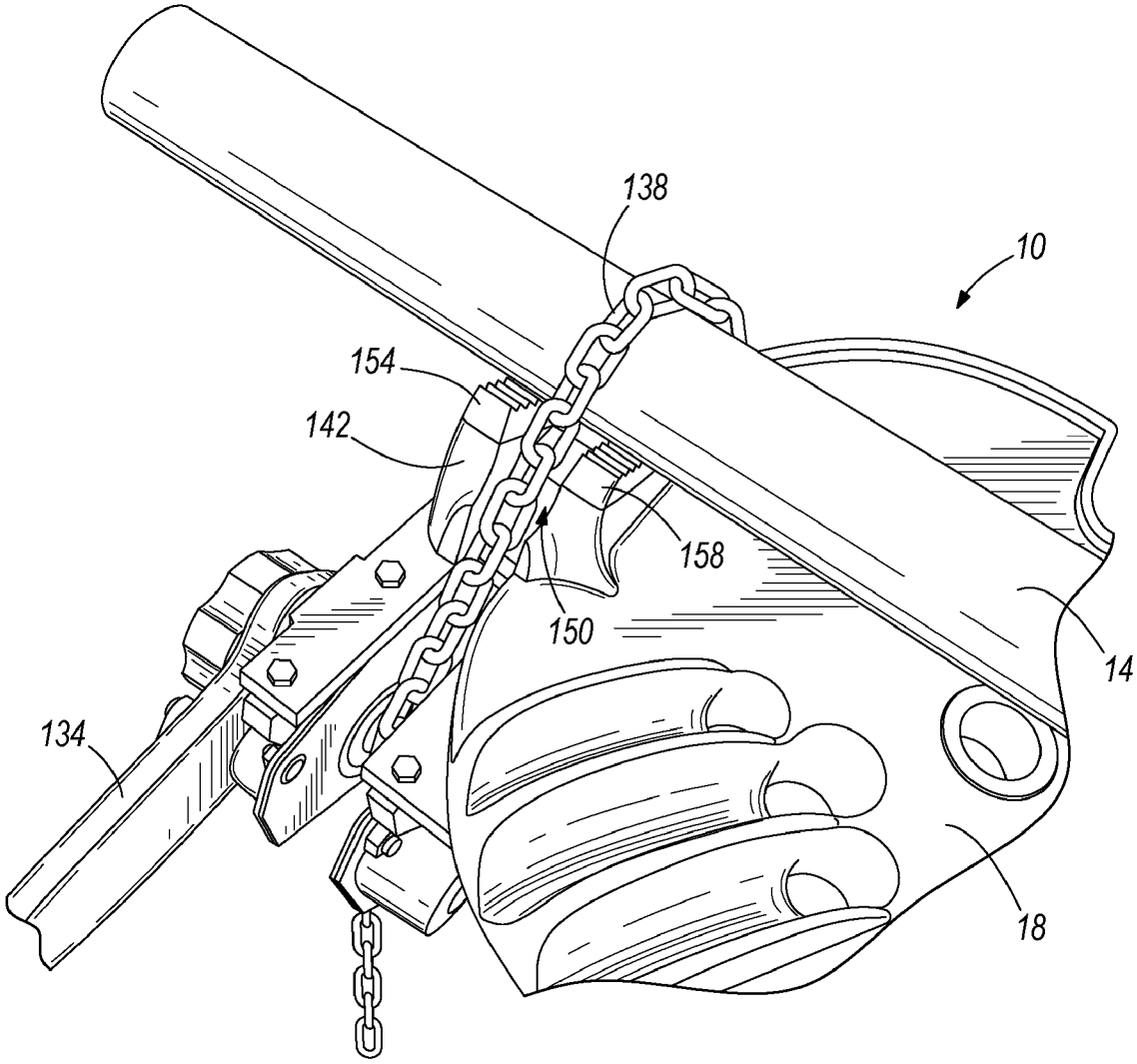

In further embodiments, additional types of clamping devices may be coupled to the pipe stand 10. For example, FIGS. 3A-3C illustrate a clamping device 130 that includes a winch 134 and a chain 138 movable by the winch 134. The winch 134 is removably coupled to the table 18 of the pipe stand 10. In other embodiments, the winch 134 may be removably coupled to one of the supports 22. The illustrated winch 134 is hand-powered and cranks or rolls the chain 138 against the pipe 14 to tighten or secure the pipe 14 to the table 18. In other embodiments, the winch 134 may be powered by a motor or a pump.

Also shown in FIGS. 3A-3C is an alternative embodiment for a pair of jaws 142, 146 for the pipe stand 10. The first jaw 142, illustrated in FIGS. 3A-3C, includes a groove 150 that separates the first jaw 142 into a first portion 154 and a second portion 158. The chain 138 of the clamping device 130 sits in the groove 150 and engages a greater amount of the circumference of the pipe 14 than the chain 118 illustrated in FIGS. 1 and 2. The second jaw 146 (FIG. 3B) engages a smaller surface area of the pipe 14. In addition, the second jaw 146, in comparison to the first and second jaws 54, 58 (FIGS. 1 and 2), supports pipes 14 having a greater diameter.

Figure 4:
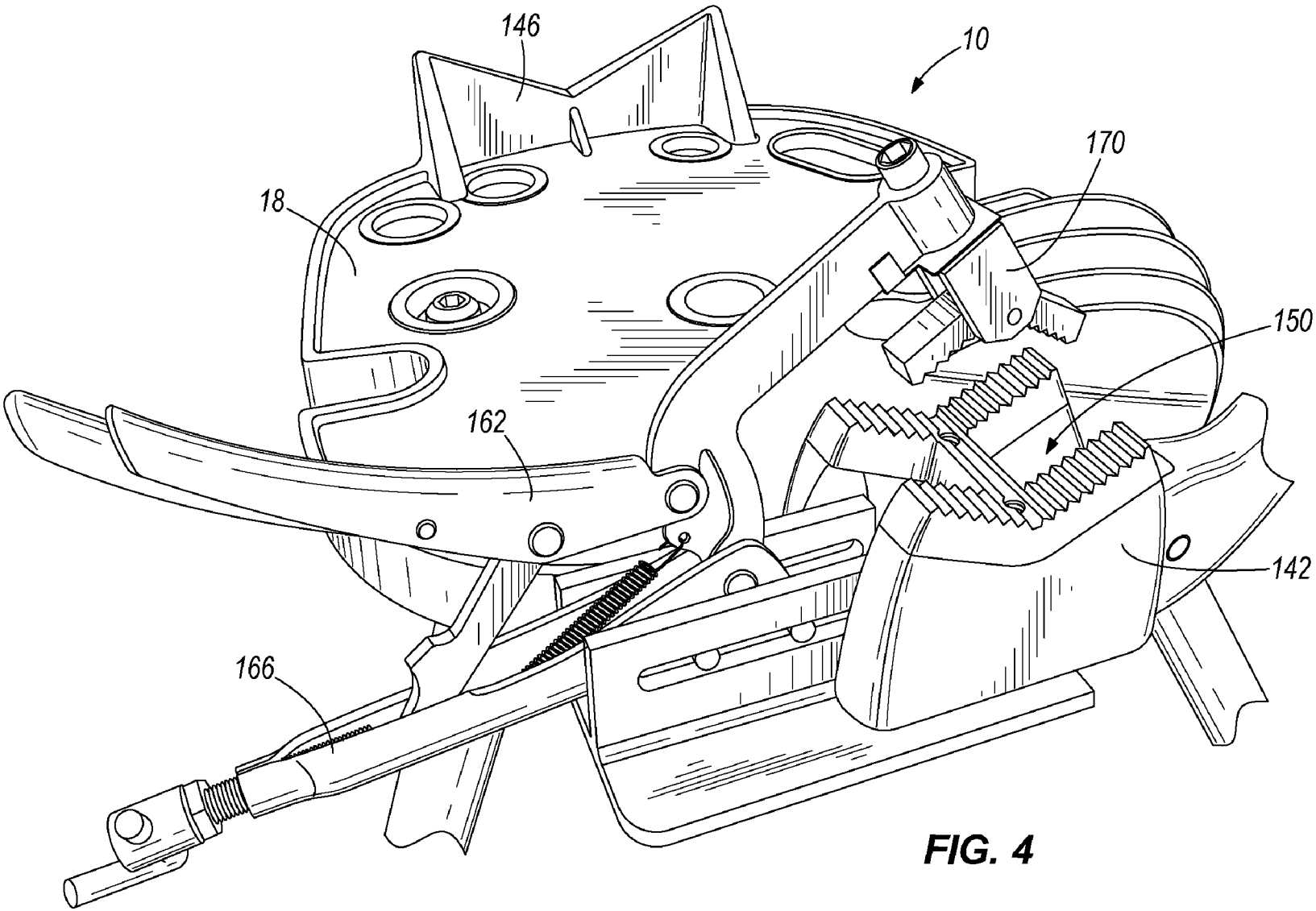
FIG. 4 is a perspective view of a vise clamping device for the pipe stand shown in FIG. 1.

FIG. 4 illustrates another clamping device 162 for coupling to the pipe stand 10. The clamping device 162 includes a ratchet tool 166 and a vise jaw 170. The ratchet tool 166 is hand-powered to actuate the vise jaw 170. The vise jaw 170 engages the pipe 14 and firmly holds the pipe 14 between the vise jaw 170 of the clamping device 162 and, for example, the first jaw 142 (FIGS. 3A-3C).

Figure 5A:
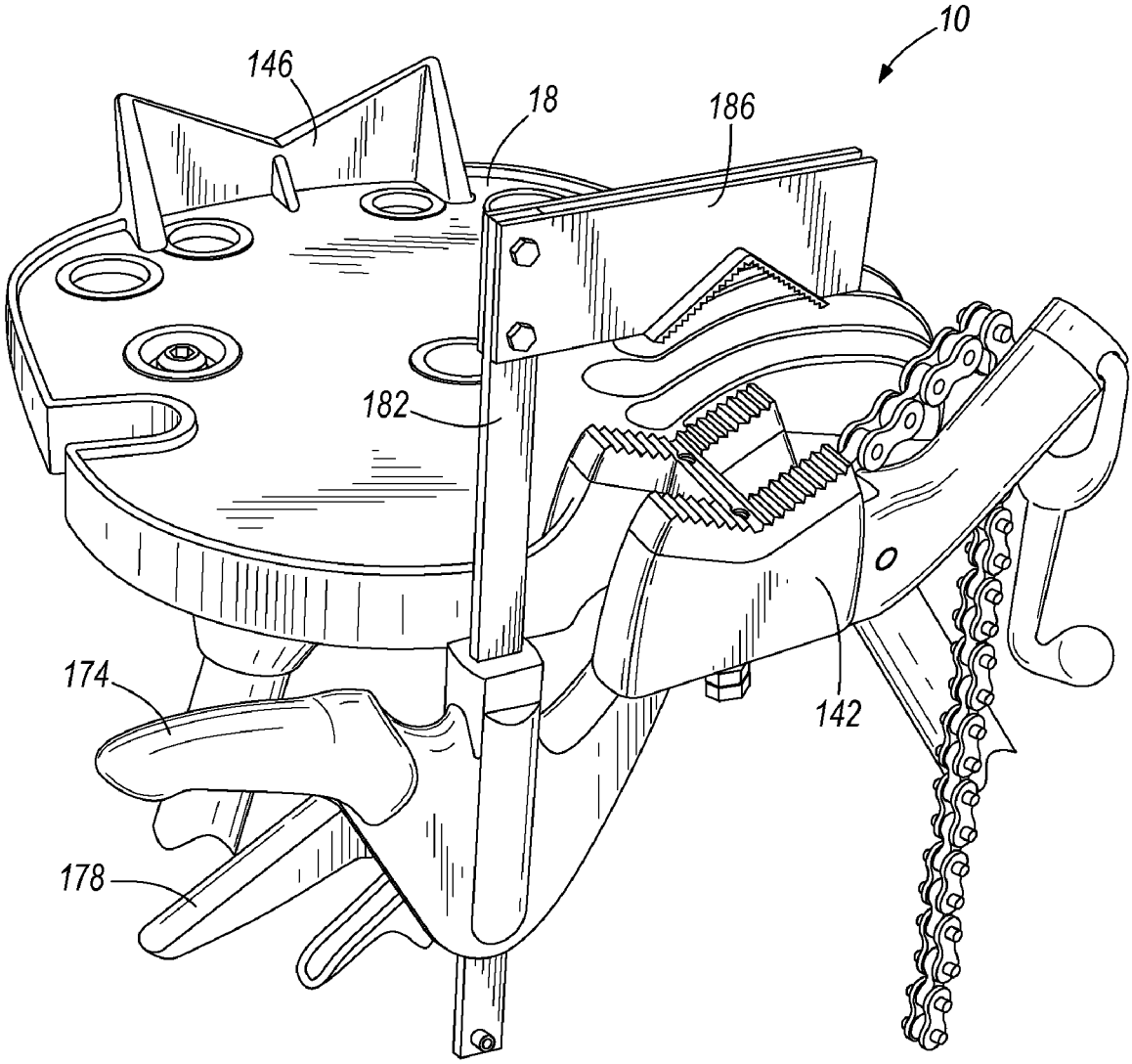
FIGS. 5A and 5B are perspective views of another vise clamping device for the pipe stand shown in FIG. 1.
Figure 5B:
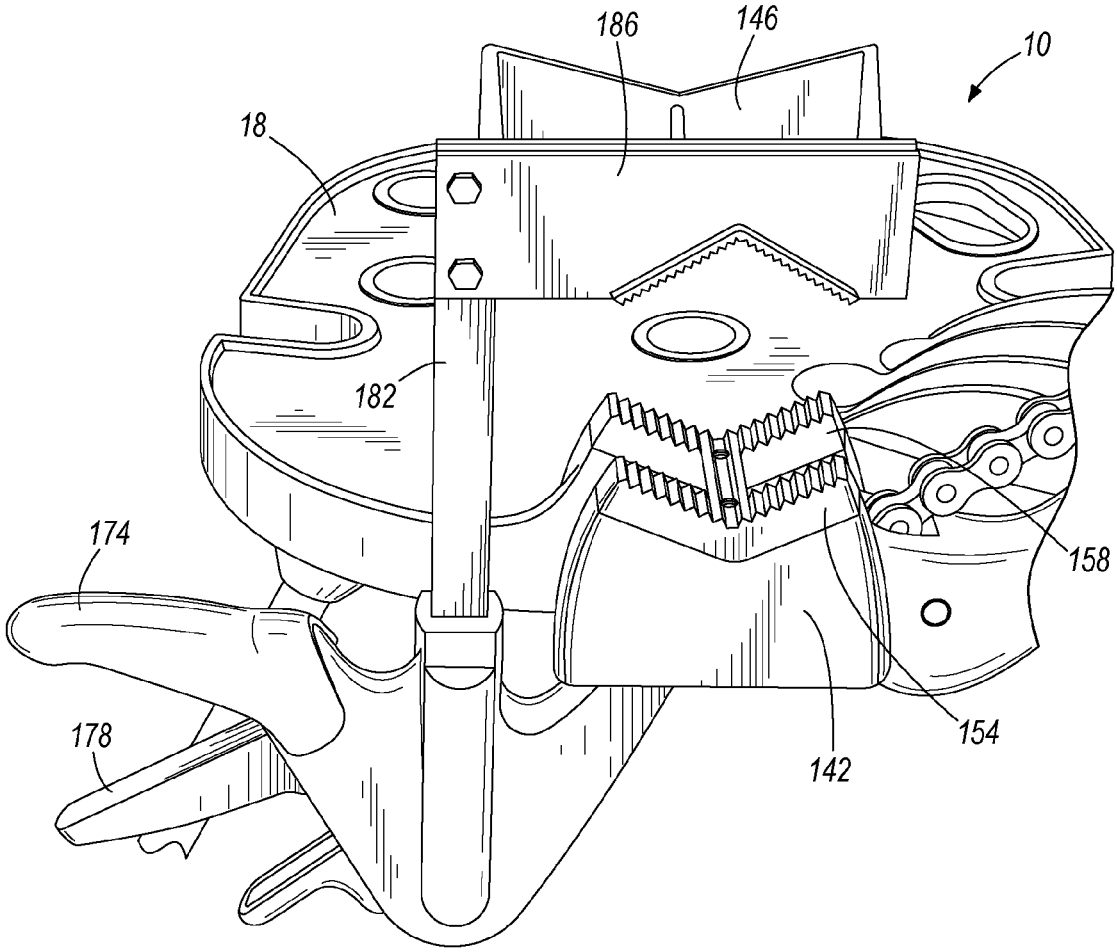

FIGS. 5A and 5B illustrate a vise clamping device 174 for coupling to the pipe stand 10. The vise clamping device 174 includes a quick clamp 178, a bar 182 movable and engageable within the quick clamp 178, and a vise jaw 186 coupled to the bar 182. The pipe 14 is firmly held between the vise jaw 188 coupled to the bar 182 and the first jaw 142 (FIGS. 3A-3C).

Figure 6A:
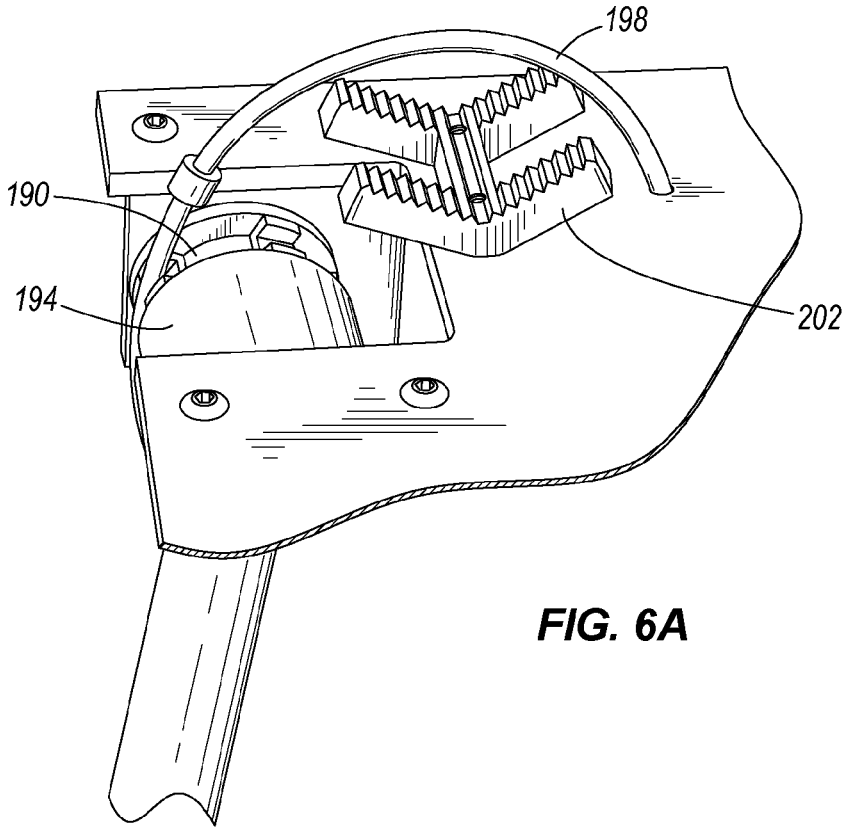
FIGS. 6A-6C are perspective views of yet another vise clamping device for the pipe stand shown in FIG. 1.
Figure 6B:
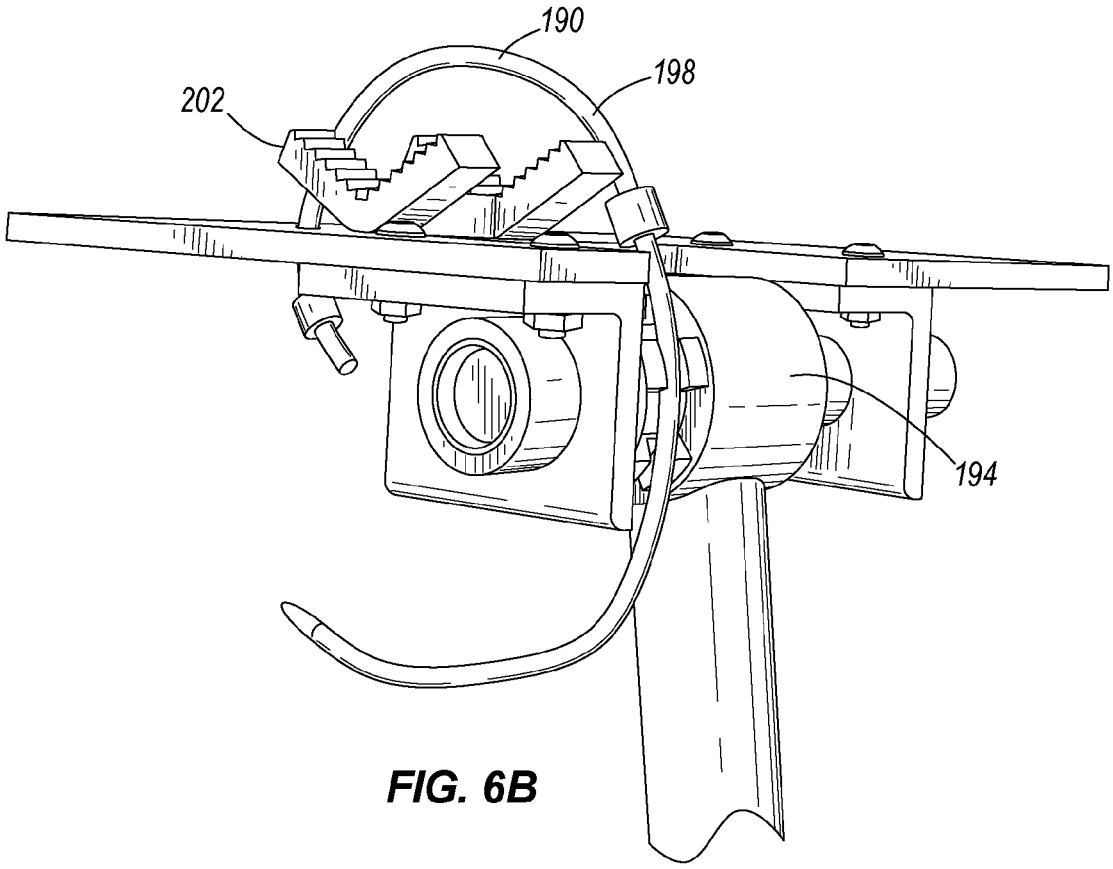
Figure 6C:
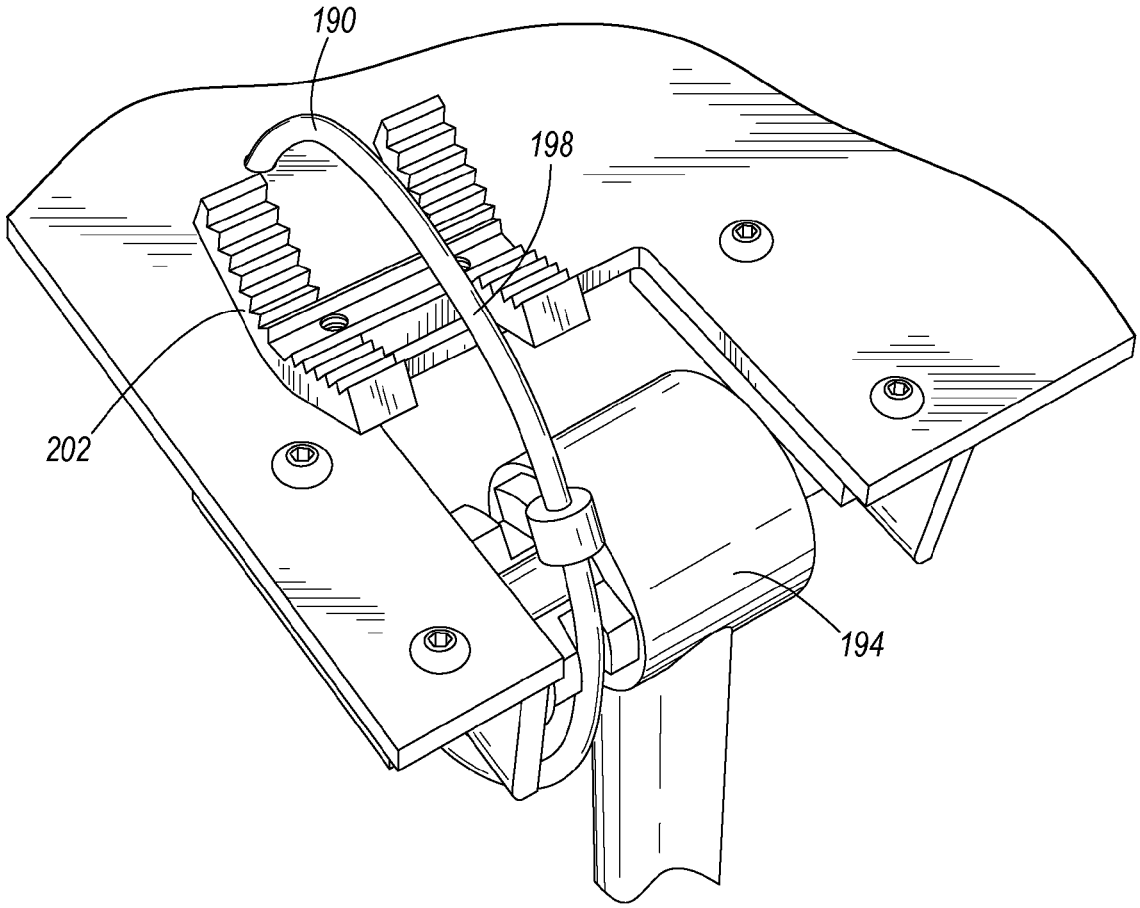

FIGS. 6A-6C illustrate another clamping device 190 for coupling to the pipe stand 10. The clamping device 190 includes a clutch mechanism 194 and a cable 198. The cable 198 is tightened by the clutch mechanism 194 and firmly holds the pipe 14 (FIGS. 1 and 2) within a jaw 202.

Figure 7:
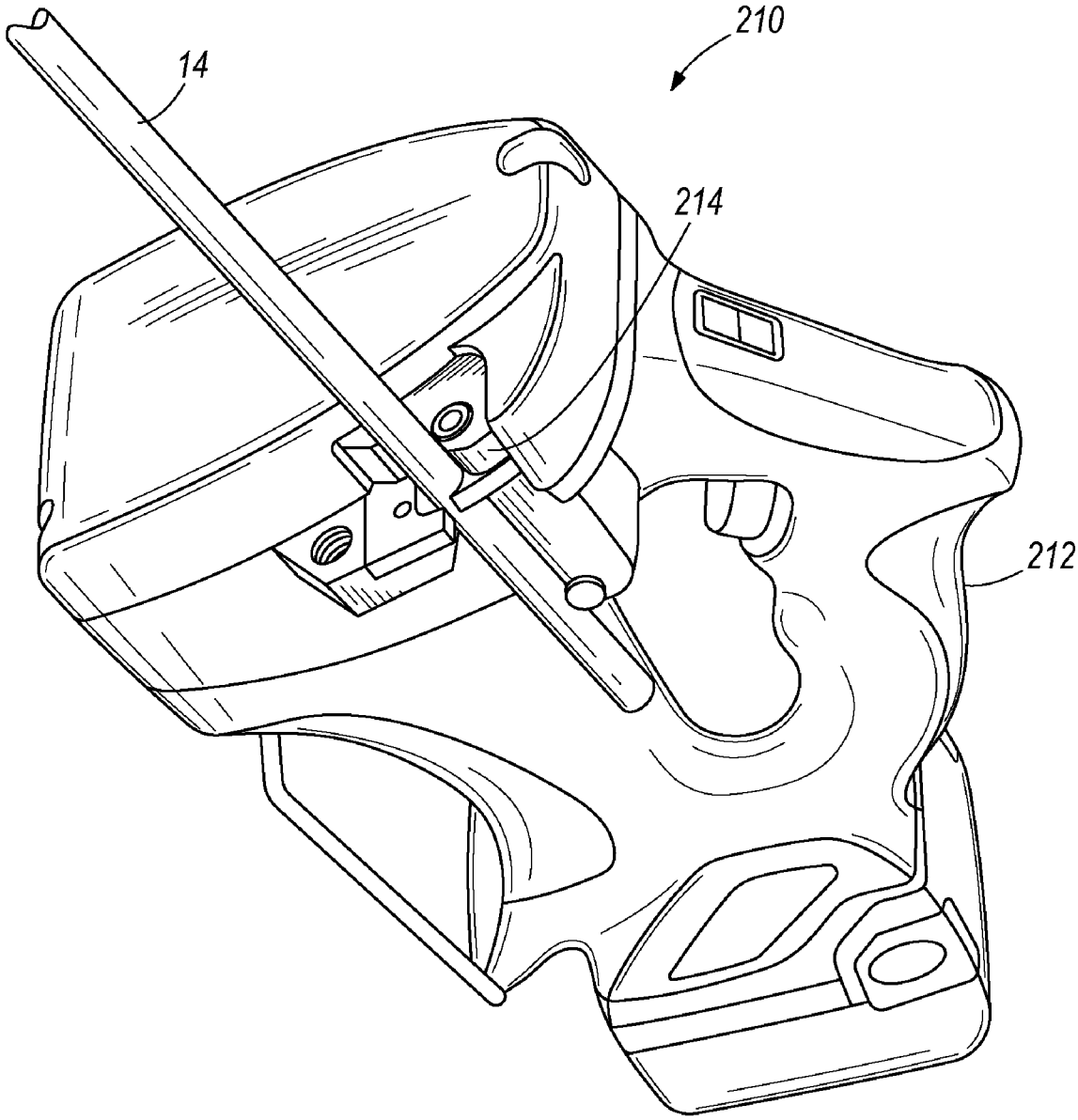
FIG. 7 is a perspective view of a threaded rod cutter for the pipe stand shown in FIG. 1.

Referring to FIGS. 1 and 2, the pipe stand 10 also includes a threaded rod cutter 200 used to machine threads onto the pipe 14. The threaded rod cutter 200 is built into the lip 46 of the pipe stand 10 and includes a housing and a cutting assembly (not shown). In other embodiments, the threaded rod cutter is removably coupled to the table 18. For example, FIG. 7 illustrates a threaded rod cutter 210 that may be removably coupled to the pipe stand 10. The threaded rod cutter 210 is a hand-held tool and includes a housing 212 and a cutting assembly 214. The threaded rod cutter 210 may be removably coupled to the table 18 by attaching the housing 212, for example, to the lip 46 of the table 18. To machine the threads onto the pipe, the pipe 14 may be supported by either of the pair of vise jaws 54, 58 (FIGS. 1 and 2) or the threaded rod cutter 210. In other embodiments, the threaded rod cutter 210 may be removably coupled to one or more of the supports 22.

Figure 8:
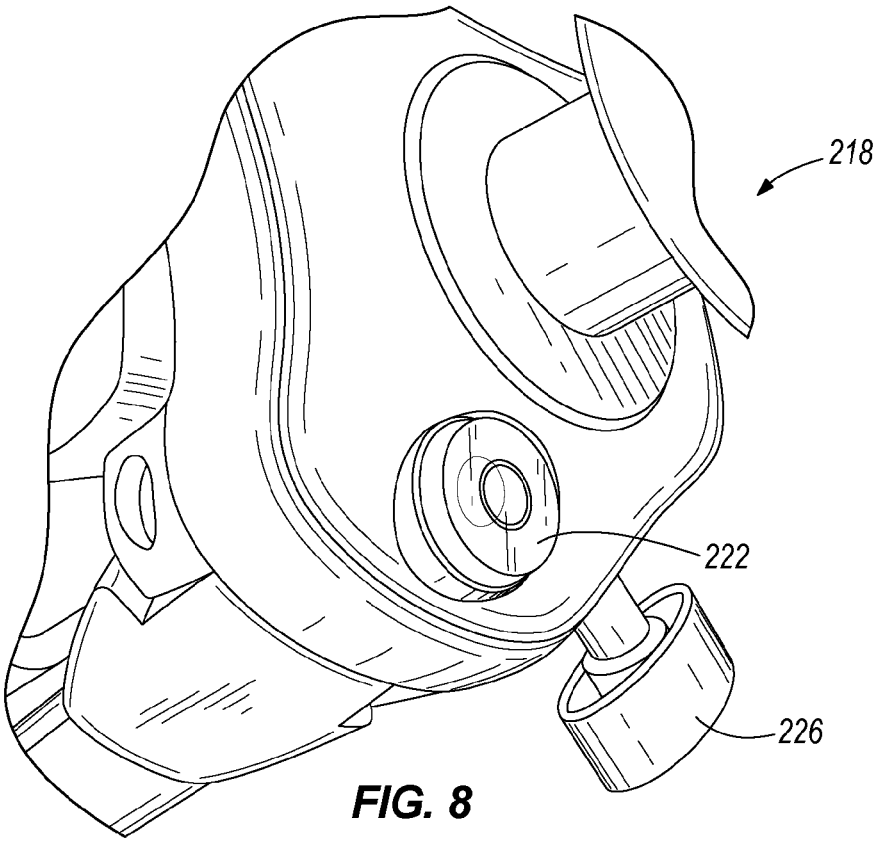
FIG. 8 is a perspective view of a leveling assembly for the pipe stand shown in FIG. 1.

FIG. 8 illustrates a leveling assembly 218 for the pipe stand 10. The leveling assembly 218 includes a bubble level 222 and a fine-adjustment knob 226. In the illustrated embodiment, the bubble level 222 is positioned on the table 18 (FIGS. 1 and 2) and a fine-adjustment knob 226 is integrated into each of the supports 22. The user may observe the bubble level 222 and accordingly adjust the height of the table 18 via the fine-adjustment knobs 226 on the supports 22. Observation and adjustment of the bubble level 222 and fine-adjustment knobs 226, respectively, occurs until the bubble level 222 indicates that the table 18 of the pipe stand 10 is substantially level. In other embodiments, the bubble level 222 is removable from the pipe stand 10.

Figure 9:
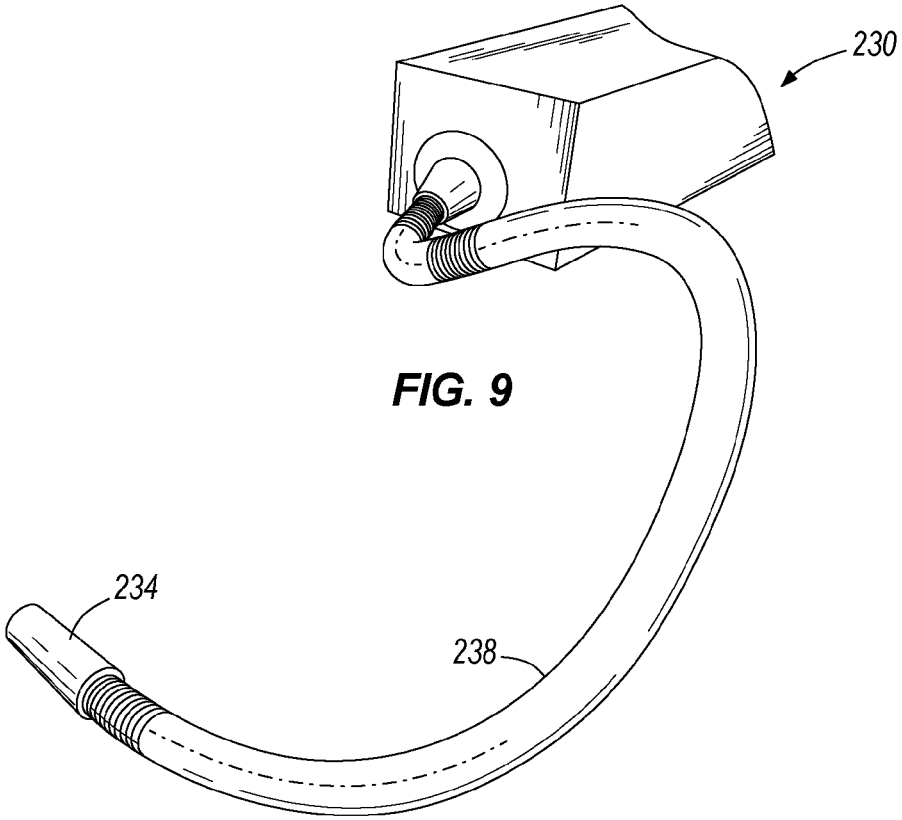
FIG. 9 is a perspective view of a flex-light for the pipe stand shown in FIG. 1.
Figure 10A:
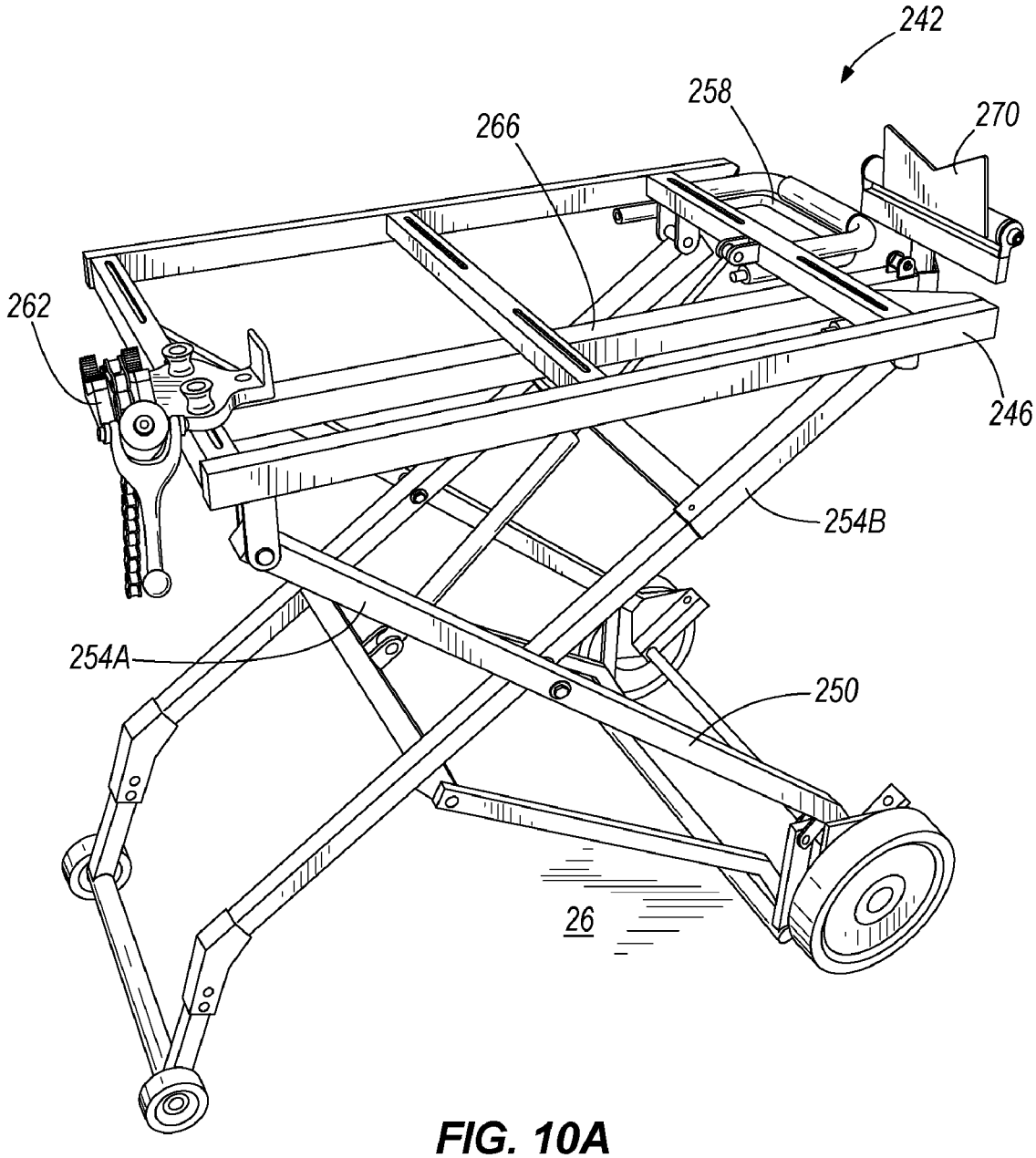
FIG. 10A is a perspective view of a pipe stand according to another embodiment of the invention.
Figure 10B:
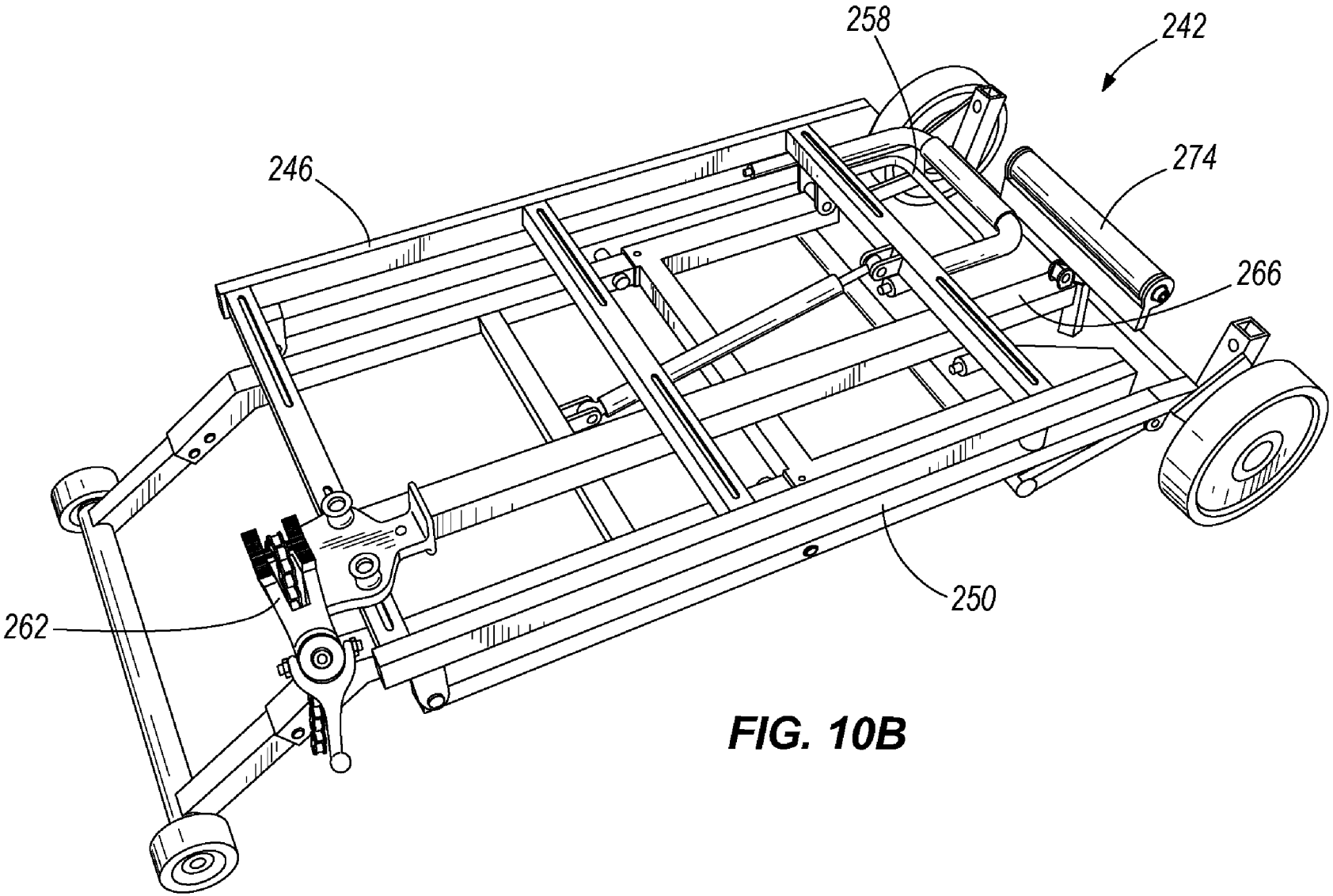
FIG. 10B is a perspective view of the pipe stand shown in FIG. 10A in the collapsed position.
Figure 10C:
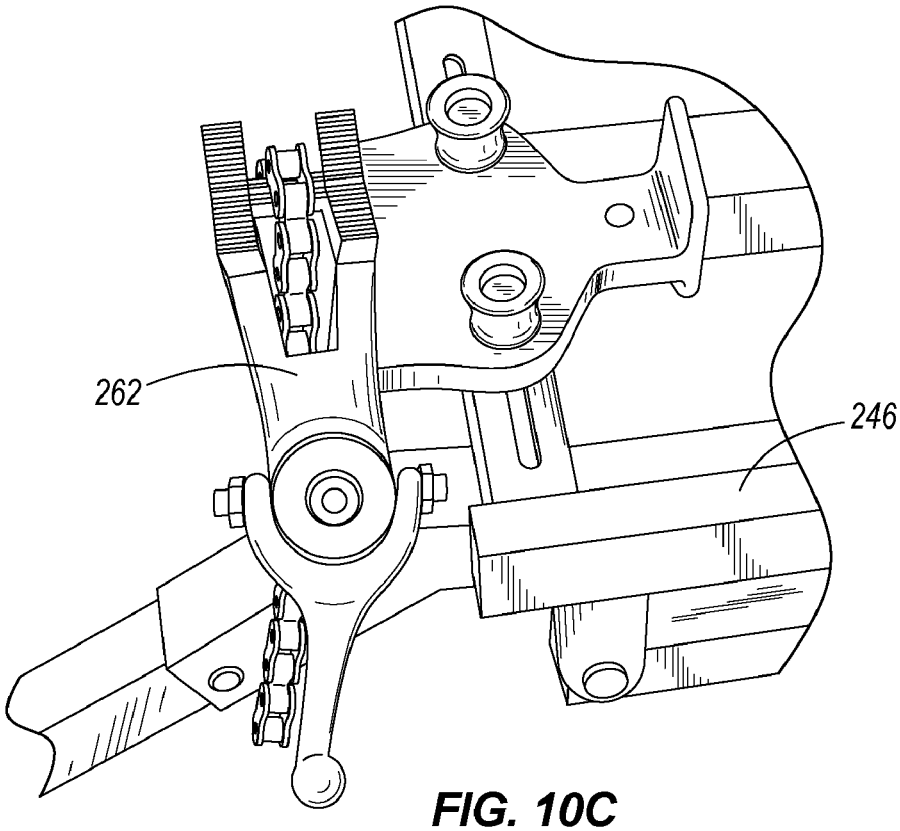
FIG. 10C is an enlarged view of a clamping device for the pipe stand shown in FIG. 10A.
Figure 10D:
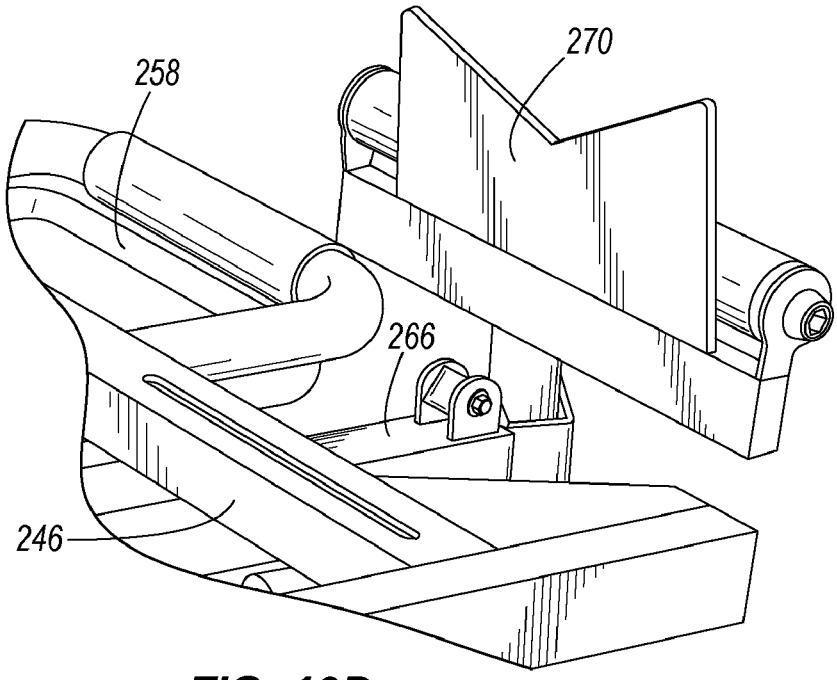
FIG. 10D is an enlarged view of an extension arm for the pipe stand shown in FIG. 10A.

FIG. 9 illustrates a flex-light 230 that may be coupled to the pipe stand 10 for illuminating the table 18. The flex-light 230 includes a light source 234 (e.g., a light bulb) and a flexible cord 238. The flexible cord 238 may extend from, for example, the first surface 38 of the table 18. The flexible cord 238 couples the light source 234 to the table 18. To direct the light source 234 and therein illuminate a desired location, the user moves the flexible cord 238 to position the light source 234 proximate the desired location. When the flex-light 230 is in the desired position and the user releases the flexible cord 238, the flexible cord 238 retains the released position. In other embodiments, the pipe stand 10 includes multiple flex-lights 230 that couple to the table 18 or to the supports 22. The flex-light 230 is powered by the local power source (i.e., the outlets 86) and a power cord, or by the remote power source and internal wires electrically communicating with the flex-light 230.

In other embodiments, one or more hooks are built into the pipe stand 10 for supporting various items, such as a radio, extension cords, extra band saw blades, battery charger, etc. The hooks may be positioned on the table 18, the shelf 30, one or more of the supports 22, or combinations thereof. In addition, the hooks may be pivotable or substantially fixed with respect to the pipe stand 10.

In yet another embodiment, a radio is built into the table 18 of the pipe stand 10. For example, the radio is coupled to the second surface of the table 18. The radio may be powered via a battery (not shown) and/or the local power source (i.e., the outlets 86). The electrical connection between the outlets 86 and the radio may be a hard-wired connection, such as a power cord, or internally wired such that the radio may be powered by the pipe stand power cord 94. In other embodiments, various electrical components (e.g., portable power tools, a radio, lights, etc.) are built into the pipe stand 10 such that electrical power is supplied through the pipe stand 10.

In some embodiments, the pipe stand 10 includes a holster for supporting and storing a power tool, such as, for example, a grinder, a drill, etc. In one embodiment, the holster is defined by a recessed area in the table 18. The recessed area is shaped to complement the supported power tool. In another embodiment, the holster is a removable structure coupled to any of the table 18, supports 22, or shelf 30. The holster may include an aperture to allow a drill bit or blade to remain attached to the power tool when stored in the holster.

The pipe stand 10 may also include battery operated tools, such as a grinder, a pipe cleaner, or a pipe rotator. Each battery operated tool may be integrated into the pipe stand 10. For example, the pipe cleaner may be built into or coupled to the table 18 of the pipe stand 10.

In addition to the outlets 86, the pipe stand 10 includes, in some embodiments, a battery charger. The battery charger may be of various types of battery chargers, such as a 12-Volt, an 18-Volt, or a 28-Volt. In other embodiments, the pipe stand 10 includes more than one battery charger and therein more than one type of battery charger. The battery charger may be positioned in various locations on the pipe stand 10. For example, the battery charger may be positioned on one of the supports 22, on the second surface of the table 18, or on the shelf 30. The battery charger may also be positioned proximate the outlets 86.

In some embodiments, the pipe stand 10 includes a conduit holder or multiple conduit holders for the storage of pipes 14, which is coupled to one of the supports 22 of the pipe stand 10. In one embodiment, the conduit holder is coupled to one of the supports 22 and includes a base having a cavity for retaining ends of pipes 14 and a ring for holding the pipes 14 substantially parallel to the said support 22. The base of the conduit holder is positioned proximate the base 102 of the support 22 and the ring of the conduit holder is positioned proximate the table 18 of the pipe stand 10. In another embodiment, the conduit holder is a single tubular holder having one closed end and one open end for inserting pipes 14.

In other embodiments, the conduit holder is coupled to the table 18. The conduit holder may be a single tubular holder having one closed end and one open end. The table 18 includes an aperture that extends from the first surface 38 to the second surface of the table 18. The aperture is dimensioned to permit multiple pipes 14 to be inserted length-wise through the aperture. The conduit holder may be coupled to the table 18 such that the open end of the conduit holder is positioned about a periphery of the aperture of the table 18, therein permitting multiple pipes 14 to be inserted through the aperture. The pipes 14 are then held within the conduit holder for the user to reach upon when needed.

FIGS. 10A-10D illustrate a pipe stand 242 according to another embodiment of the invention. The pipe stand 242 includes a table 246 and a support assembly 250 for elevating the table 246 with respect to the support surface 26. The pipe stand 242 may include any of the various accessories discussed above with reference to FIGS. 1 and 2. The pipe stand 242 is movable between a first position shown in FIG. 10A (i.e., an upright or elevated position) and a second position shown in FIG. 10B (i.e., a collapsed or folded position). The support assembly 250 is a scissor-like structure including two hinged portions 254A, 254B that move the pipe stand 242 between the first and second positions. When the pipe stand 242 is in the first position, the user may actuate a handle 258 of the support assembly 250 to disengage or release the two hinged portions 254A, 254B from the first position, and thereby allow the table 246 of the pipe stand 242 to collapse to the second position such that the table 246 and two hinged portions 254A, 254B are substantially parallel to one another.

Figure 11:
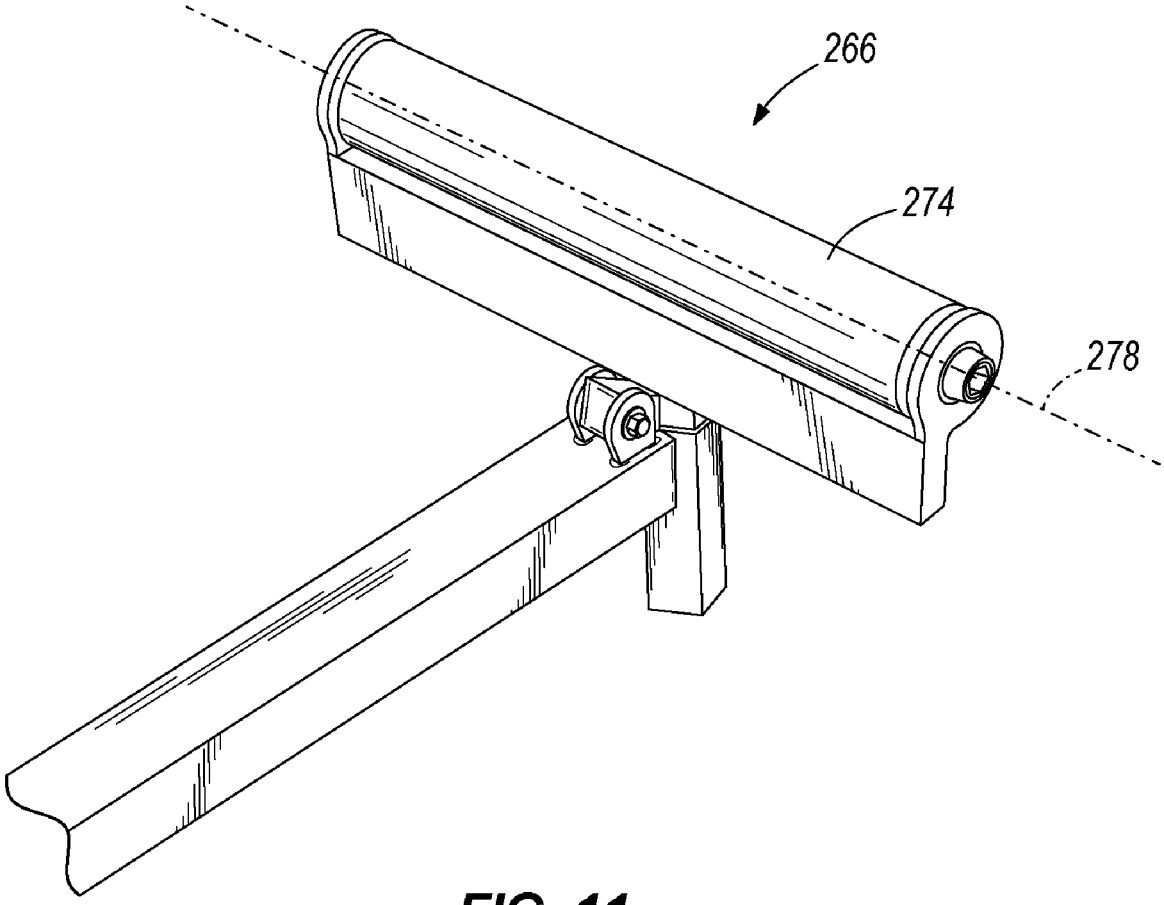
FIG. 11 is a perspective view of an extension arm for the pipe stand shown in FIG. 10A.

The table 246 of the pipe stand 242 includes a clamping device 262 and an extension arm 266. The clamping device 262 (FIG. 10C), is similar to the clamping device 130 illustrated in FIGS. 3A-3C; however, in other embodiments, the clamping device 262 may be any of the clamping devices discussed above or other clamping devices. The extension arm 266 (FIGS. 10D and 11) is extendable from the table 246 of the pipe stand 242 to a first position (i.e., an extended position illustrated in FIG. 11) to assist in supporting a pipe 14 having an increased length. The extension arm 266 may also reduce stress and strain in the pipe 14 typically caused by the cantilevered weight of the increased length hanging off the table 246.

The extension arm 266 includes a jaw 270 (FIGS. 10A and 10D) coupled to the extension arm 266 to aid the clamping device 262 in firmly holding the pipe 14 to the table 246 for machining. Furthermore, the jaw 270 may be removably coupled to the roller 270 to resist movement of the pipe 14 parallel to a rotation axis 278 of the roller 270. The extension arm includes a roller 274 (FIGS. 10B and 11), which allows a user to easily move the pipe 14 with respect to the table 246.

Although the invention has been described in detail with reference to certain preferred embodiments, variations and modifications exits within the scope and spirit of one or more independent aspects of the invention as described. Various features and advantages of the invention are set forth in the following claims.

The invention claimed is:

1. A pipe stand for supporting a conduit, the pipe stand comprising:

a table including a first surface;

a plurality of supports pivotably coupled to the table for supporting the table in an elevated position with respect to a support surface, wherein at least one of the supports includes an electrical connector;

a power cord in electrical communication with the electrical connector and connectable to an external power source;

a shelf extending between the supports, the shelf positioned between the table and the support surface;

a first jaw extending from the first surface of the table and shaped to engage a portion of the conduit;

a second jaw extending from the first surface of the table and spaced a distance from the first jaw, the second jaw shaped to engage another portion of the conduit; and a clamping device supported by one of the first jaw and the second jaw, the clamping device including a cord removeably coupled to the table and engageable with the conduit and a winch for biasing the cord with respect to the conduit.

2. The pipe stand of claim 1, wherein the cord is at least one of a chain and a cable.

3. The pipe stand of claim 1, wherein the first and second jaws further include a plurality of conduit engaging ribs.

4. The pipe stand of claim 1, wherein the winch includes an electric motor.

5. The pipe stand of claim 1, wherein the electrical connector includes a GFCI outlet.

6. The pipe stand of claim 1, wherein at least one of the supports includes an adjustment apparatus to adjust a length of the support.

7. The pipe stand of claim 1, and further comprising a leveling assembly coupled to the table.

8. The pipe stand of claim 7, wherein the leveling assembly further includes a bubble level.

9. A pipe stand for supporting a conduit, the pipe stand comprising:

a table including a first surface;

a plurality of supports pivotably coupled to the table for supporting the table in an elevated position with respect to a support surface;

a leveling system coupled to the table wherein the leveling system includes an adjustment apparatus for adjusting a length of at least one of the supports;

an electrical connector supported by at least one of the supports;

a power cord in electrical communication with the electrical connector and connectable to an external power source;

a shelf extending between the supports and positioned between the table and the support surface;

a first jaw extending from the first surface of the table and shaped to engage a portion of the conduit;

a second jaw extending from the first surface of the table and spaced a distance from the first vise jaw, the second jaw shaped to engage another portion of the conduit; and a clamping device supported by one of the first jaw and the second jaw, the clamping device including a cord removeably coupled to the table and engageable with the conduit and a winch for biasing the cord with respect to the conduit.

10. The pipe stand of claim 9, wherein the cord is at least one of a chain and a cable.

11. The pipe stand of claim 9, wherein at least one of the first jaw and the second jaw includes a plurality of conduit engaging ribs.

12. The pipe stand of claim 9, wherein the electrical connector includes a GFCI outlet.

13. The pipe stand of claim 9, wherein the winch includes an electric motor.

14. The pipe stand of claim 9, wherein the leveling system includes a bubble level.

15. A pipe stand for supporting a conduit, the pipe stand comprising:

a table including a first surface;

a plurality of supports pivotably coupled to the table for supporting the table in an elevated position with respect to a support surface, wherein at least one of the supports includes an electrical connector;

a power cord in electrical communication with the electrical connector and connectable to an external power source;

a shelf extending between the plurality of supports and positioned between the table and the support surface;

a first jaw extending from the first surface of the table and shaped to engage a portion of the conduit;

a second jaw extending from the first surface of the table and spaced a distance from the first jaw, the second jaw shaped to engage another portion of the conduit; and a vise clamping device supported by one of the first jaw and the second jaw.

16. The pipe stand of claim 15, wherein the vise clamping device is pivotably adjustable with respect to the conduit.

17. The pipe stand of claim 15, wherein the vise clamping device is linearly adjustable with respect to the conduit.

18. The pipe stand of claim 15, wherein the electrical connector is a GFCI outlet.

19. The pipe stand of claim 15, wherein at least one of the plurality of supports includes an adjustment apparatus for adjusting a length of the support.

20. The pipe stand of claim 15, and further comprising a leveling system coupled to the table.

* * * * *